United States Patent [19]

Monson et al.

[11] Patent Number: 4,930,178

[45] Date of Patent: Jun. 5, 1990

[54] COMPACT SELF-CONTAINED RECYCLING EXTRACTION CLEANER

[76] Inventors: Clifford L. Monson, 1765 Ala Moana Blvd., Unit 280, Honolulu, Hi. 96815; Danny C. Perry, 129 Polihale Pl.; Theodor Domay, 146 Polihale Pl., both of Honolulu, Hi. 96825; Henry A. Wilks, 115 Alkapa Pl., Kailua, Hi. 96734

[21] Appl. No.: 755,796

[22] Filed: Jul. 17, 1985

[51] Int. Cl.[5] ..... A47L 5/24

[52] U.S. Cl. ..... 15/320; 15/344; 15/353

[58] Field of Search ..... 15/320, 321, 344, 353; 55/403

[56] References Cited

U.S. PATENT DOCUMENTS

| | | | |
|---|---|---|---|
| 1,661,480 | 3/1923 | Keefer . | |
| 2,188,031 | 1/1940 | Brock | 55/403 |
| 2,355,322 | 8/1944 | Nuffer et al. | 15/344 |
| 2,680,260 | 6/1954 | Danielsson et al. . | |
| 2,986,764 | 6/1961 | Krammes . | |
| 3,040,362 | 6/1962 | Krammes . | |
| 3,431,582 | 3/1969 | Grave | 15/353 X |
| 4,019,218 | 4/1977 | Cyphert | 15/321 |
| 4,156,952 | 6/1979 | Lynch, Jr. . | |
| 4,164,055 | 8/1979 | Townsend | 15/353 X |
| 4,170,805 | 10/1979 | Kumagai | 15/353 X |
| 4,227,279 | 10/1980 | Tribolet | 15/321 |
| 4,536,914 | 7/1985 | Levine | 15/344 |
| 4,542,557 | 9/1985 | Levine | 15/344 |
| 4,549,329 | 10/1985 | St. Clair | 15/320 X |

*Primary Examiner*—Harvey C. Hornsby
*Assistant Examiner*—Scott J. Haugland
*Attorney, Agent, or Firm*—Sixbey, Friedman, Leedom & Ferguson

[57] ABSTRACT

A compact, self-contained recycling extraction cleaner having a body member wherein a handle half of the body has all of the electrical components, except possibly the cleaning fluid pump, sealed therein, and the cleaning fluid is retained within a removable discharge head half of the body that defines a plenum chamber and carries a spray nozzle, filter and vacuum intake head, as well as, perhaps, the cleaning fluid pump. Furthermore, in accordance with another feature, solution conduits to and from the pump may be built into the wall of the body in a manner that, when the cleaning fluid pump is located in the handle half, the conduit portions of the two halves sealingly mate in the assembled condition of the body halves. Still further, arrangements are provided for preventing cleaning solution from being discharged through the vacuum intake head or flowing into the vacuum blower.

12 Claims, 3 Drawing Sheets

COMPACT SELF-CONTAINED RECYCLING EXTRACTION CLEANER

TECHNICAL FIELD

The present invention relates generally to recycling-type extraction cleaners and more specifically to such cleaning apparatus which is compact, light-weight, portable and completely self-contained.

BACKGROUND ART

Cleaning machines of the type wherein a washing liquid is fed from a receptacle to a surface to be washed and, then, by means of suction, is returned to the original receptacle for further use, preferably after being filtered are known. For example, in Keefer U.S. Pat. No. 1,661,480, such a cleaning machine is disclosed wherein a tank-like receptacle is provided that houses the pump for dispensing the cleaning liquid, the suction fan for returning the liquid, and the filtering means, while also providing the storage facility for the cleaning liquid. The tank-like receptacle is designed to sit on the floor and flexible liquid discharge and liquid return hoses connect the tank-like receptacle with a cleaning head used to apply and retrieve the cleaning liquid from the surface being cleaned.

In Danielson et al U.S. Pat. No. 2,680,260, a form of cleaning machine is disclosed wherein a cleaning fluid is applied by the machine and is recollected through a filter back to a storage tank for recirculation. In the arrangement of this patent, instead of a hose-connected cleaning head being utilized, as in the case of the Keefer patent, the underside of a wheeled tank-like receptacle (which houses the storage tank pump and the like) has a cleaning liquid supplying conduit arranged to supply fluid centrally through a rotating brush that scrubs the surface to be cleaned. A circular mouthpiece surrounds the periphery of the brush and collects the liquid for return back up into the tank.

While devices of the aforementioned type are portable, they are anything but compact and light-weight, particularly when their cleaning fluid tank is full. Furthermore, the presence in such apparatus of a tank that must rest on the floor not only makes use of the apparatus cumbersome, but is restrictive with respect to the places that such a unit can be effectively utilized. For example, long flights of steps having no landing upon which the tank can rest can render the apparatus unusable. Furthermore, because of the cumbersome nature of such units, it is often impractical to utilize such a unit for spot cleaning purposes, such as cleaning up a small spill, as opposed to general room cleaning.

As a result, it is desirable to have a cleaning apparatus wherein all of the operative components are mounted upon a common element so that the unit is unencumbered by a separate floor-supported tank. Lynch, Jr. U.S. Pat. No. 4,156,952, and Krammes U.S. Pat. Nos. 3,040,362 and 2,986,764 show floor cleaning apparatus, configured similarly to an upright vacuum cleaner or so-called electric broom, that have all of the operative components for spraying a cleaning fluid onto a floor surface, such as a carpet, and for using suction to collect the dirty cleaning liquid, as well as a means for storing the fluid that is applied and collected mounted upon a common element. However, such apparatus are not constructed to enable recycling of the cleaning fluid, such that the cleaning capacity of the apparatus is severely limited by the amount of fluid that can be carried. Furthermore, the versatility of such "common element" type cleaning apparatus is severely restricted to floor-type uses because these units are too large and heavy to be used in a manner that is unsupported by contact with the floor surface to be cleaned and because the units are not designed for operation in orientations that would be necessary for cleaning vertical surfaces. Also, these units, while more compact and light-weight than the initially mentioned tank-type units, are not truly light-weight or compact either.

DISCLOSURE OF THE INVENTION

From the foregoing, it should be appreciated that there is a need for a cleaning apparatus that is relatively small, light-weight, easily portable, and versatile, yet is not limited in capacity to the surface area that can be cleaned with a single application of a quantity of cleaning fluid that is carriable thereby. It is, thus, a primary object of the present invention to achieve such a cleaning apparatus.

It is a further object of the present invention to construct a cleaning apparatus of the initially-mentioned type that is simple and easy to use.

Yet another object of the present invention is to enable a cleaning apparatus to be achieved that is amenable to hand-held as well as floor versions.

Still further, it is an object of the present invention to provide a cleaning apparatus of the aforementioned type that can be placed in various orientations, while loaded with cleaning solution, without damaging the apparatus or producing spillage.

These and other objects of the present invention are achieved in accordance with preferred embodiments by forming the apparatus of a body member wherein a handle half of the body has all of the electrical components, except possibly the cleaning fluid pump, sealed therein and the cleaning fluid is retained within a removable discharge head half of the body that defines a plenum chamber and carries a spray nozzle, filter and vacuum intake head, as well as, perhaps, the cleaning fluid pump. Furthermore, in accordance with another feature, solution conduits to and from the pump are built into the wall of the body in a manner that, when the cleaning fluid pump is located in the handle half, the conduit portions of the two halves sealingly mate in the assembled condition of the body halves. Still further, means are provided for preventing cleaning solution from becoming discharged through the vacuum head or flowing into the vacuum blower.

BEST MODE FOR CARRYING OUT THE INVENTION

Figure 1:
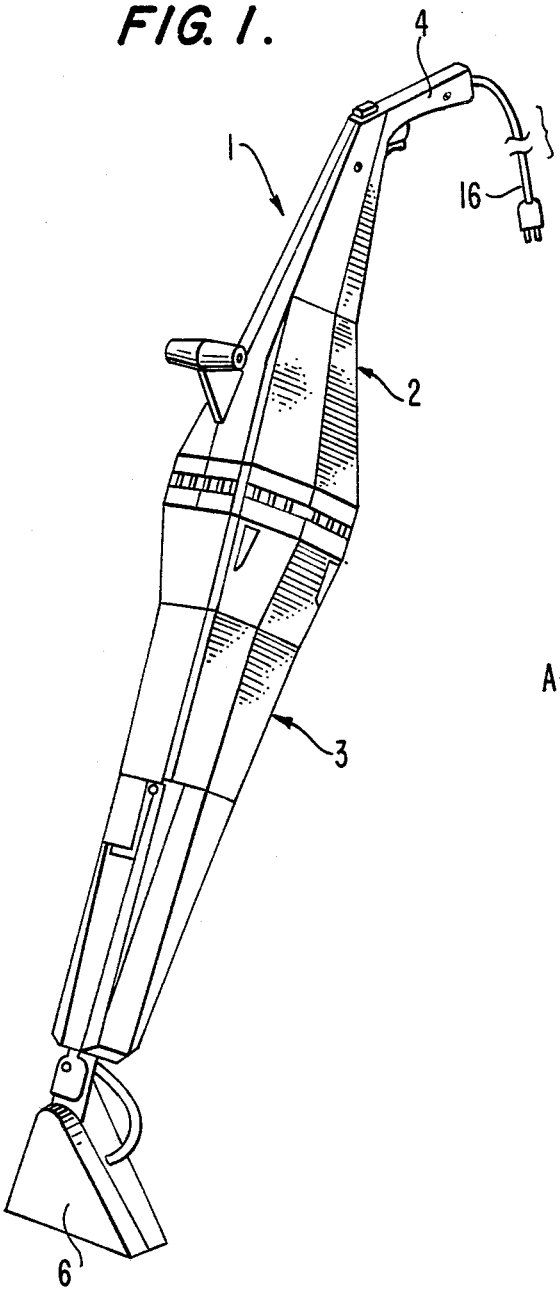
FIG. 1 is a side perspective view of an embodiment in accordance with the present invention.
Figure 2:
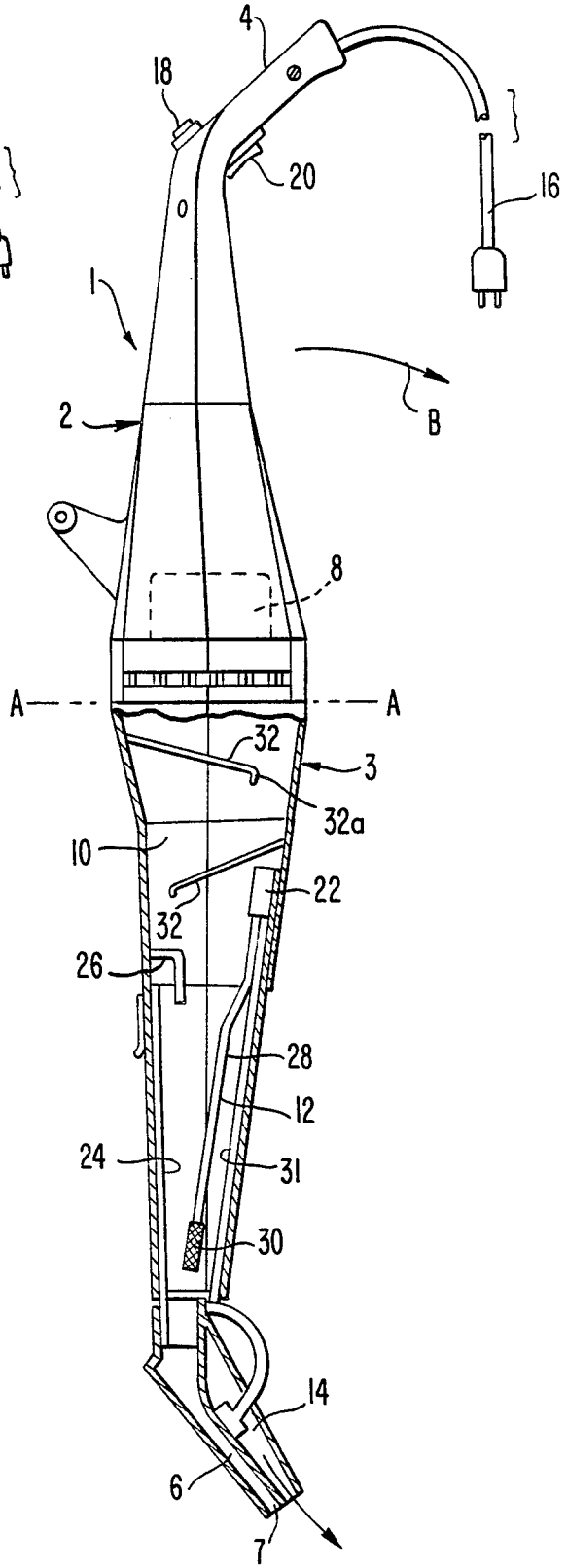
FIG. 2 is a partial cross-sectional view of the embodiment of FIG. 1.
Figure 3:
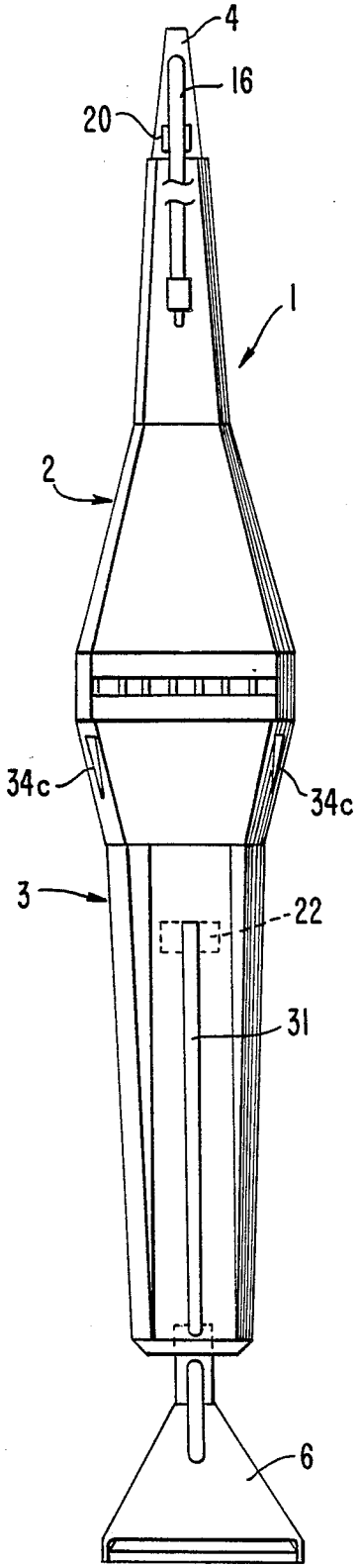
FIG. 3 is a rear elevational view of the embodiment shown in FIGS. 1 and 2.

With reference to the drawings, FIGS. 1–3 illustrate a first embodiment of a compact self-contained recycling extraction cleaner in accordance with the present invention wherein the reference numeral 1 designates the cleaner unit as a whole. The unit 1 is similar in size and configuration to a conventional "electric broom" type vacuum cleaner.

The cleaning unit 1 is, itself, formed of two main body components, an upper, handle half 2 and a lower, discharge head half 3 that are joined together at respective, matingly engageable ends, along line A—A (FIG. 2). Opposite the mating ends, the upper half 2 terminates in a handle 4, while the lower half 3 terminates in a vacuum head 6 having a downward facing intake opening 7. The two halves 2 and 3 can be held together in any conventional manner that assures a leakproof seal at the junction A—A; although, one advantageous form of such an arrangement is described in greater detail, below, in conjunction with a description of another embodiment of the invention and such an arrangement is utilizable in connection with this embodiment, as well. It should also be recognized that the term "half" is being used in relation to body components 2 and 3 in the broad sense of being one of a pair of parts forming unit 1 and should not be viewed as implying that the halves 2, 3 are equal in size.

It should be appreciated that the cleaning unit 1 in accordance with the present invention utilizes a pump system for applying a spray of cleaning fluid to the surface to be cleaned and a vacuum extraction system to recover the applied cleaning fluid and dirt entrained therewith. To this end, a vacuum motor 8 (disposed at the lower end of the handle half 2) defines the upper end of a hollow plenum chamber 10 formed within the lower half 3 of the extraction cleaner unit 1. The plenum chamber 10 is, itself, essentially an extension of a hollow cleaning fluid receptacle 12.

A spray of cleaning fluid is applied via a spray nozzle 14 (when the power cord 16 is plugged into an electrical outlet and the pump switch 20 is actuated) by the action of a self-priming pump 22, shown mounted to an inner wall of the lower discharge half of the unit 1. In particular, the pump 22 draws cleaning solution from the receptacle 12, through filter 30, and up conduit 28 to the pump, after which it is delivered, under pressure, through a spray tube 31 to the spray nozzle 14. In this regard, while the conduit 28 is a separate tube which projects into the receptacle 12, preferably, the conduit 31 is a molded or otherwise built-in portion of the wall of discharge head half 3 of the unit 1. The filter 30 prevents any solid matter that has been extracted, along with the cleaning fluid, into the receptacle 12 from being drawn up into the pump 22, which could lead to the pump becoming damaged or nozzle 12 or lines 28 and 31 becoming clogged.

In order to enable the applied cleaning fluid to be extracted by the vacuum motor 8, via the intake opening 7 of the vacuum head 6 (upon actuation of the vacuum blower switch 18), opening 7 communicates with the top of receptacle 12 (that communicates with the intake side of the vacuum motor 8 via the hollow plenum chamber 10) via the conduit 24 and deflection conduit 26. These conduits, also, are preferably built into the wall of lower half 3, such as by being molded portions of a plastic lower body half 3.

While the deflection conduit 26 serves to direct the returning cleaning fluid, and any solid materials extracted therewith, into receptacle 12, in order to further insure that no liquid or solid matter is drawn into the vacuum motor 8, advantageously, at least two drift eliminator blades 32 are provided. These blades 32 alternately extend from a respective one of opposite facing walls (front and back walls as shown) and widthwise extend fully across the width of lower half 3 (i.e., from one side wall to the opposite side wall). Each of the eliminator blades 32 angles downwardly and terminates at a free edge **32*a* that is formed with a 90° angle bend. As a result of the presence of these drift eliminator blades, air drawn upwardly into the vacuum motor is caused to following a meandering path and any liquids or solids entrained therewith will be brought into contact with these blades and then deflected back down from the plenum chamber 10 into the fluid receptacle 12, thereby avoiding such materials being drawn into the blower motor 8**.

For cleaning or filling purposes, the halves 2, 3 of the cleaning unit 1 are separated along the line A—A. Furthermore, since all of the electrical components are sealingly enclosed within the upper half 2, except for the pump 22, cleaning the interior of the lower half 3 directly under a source of running water poses no problems, pumps which are submersible without harm, being well known. Additionally, due to the location of the vacuum intake conduits 24, 26 and lowermost drift eliminator plate 32, the unit 1 can be rotated well into a horizontal orientation in the direction of the arrow B (FIG. 2) without creating any problems of cleaning fluid flowing into the vacuum blower 8 or out through the intake conduits 24, 26.

Figure 4:
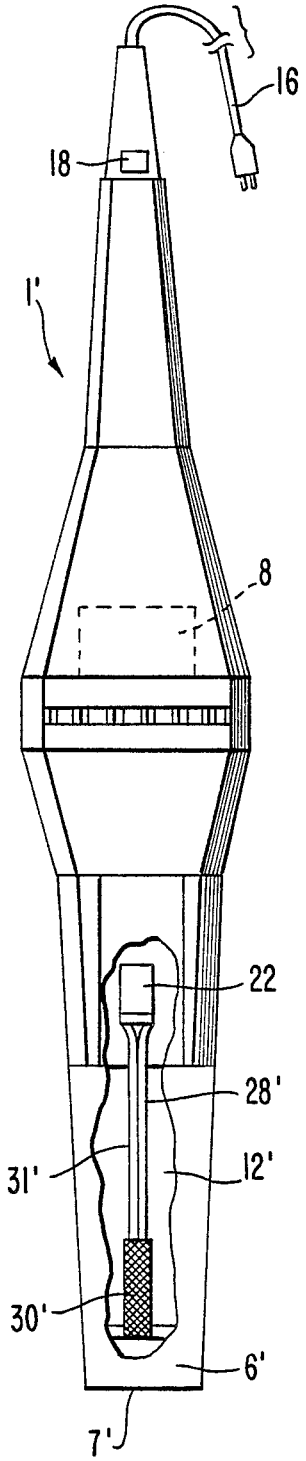
FIGS. 4 and 5 are partial front and side sectional views of a modified embodiment in accordance with the present invention.
Figure 5:
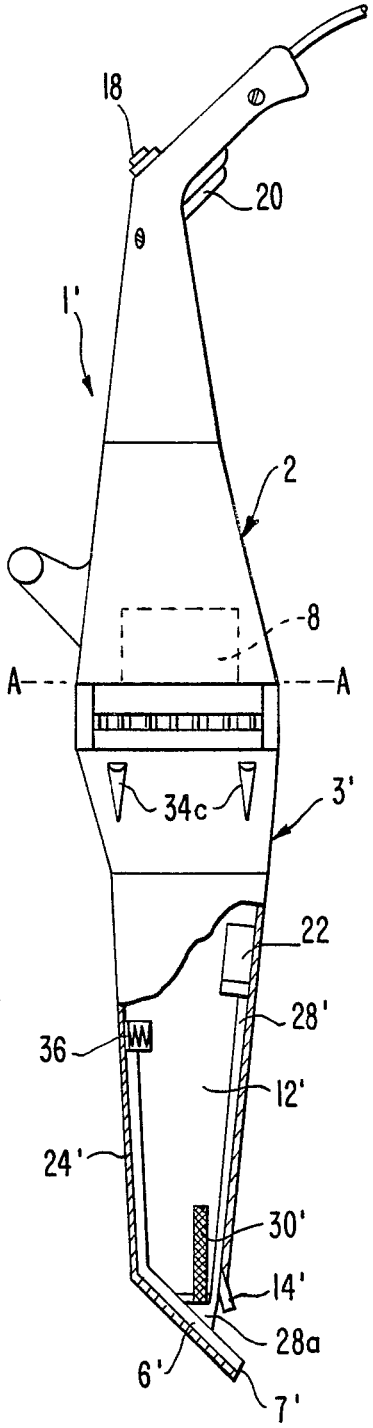

Turning now to FIGS. 4 and 5 of the drawings, a modified embodiment of a compact self-contained recycling extraction cleaner in accordance with the present invention will be described. However, since the embodiment of FIGS. 3 and 4 functions identically to that of FIG. 5, only those aspects of this embodiment which differ from the first embodiment will be described. Furthermore, in the drawings, identical parts of the two embodiments bear identical reference numerals, while corresponding but modified parts bear like reference numerals distinguished by a prime designation.

The upper, handle half 2 of the modified cleaning unit 1' is identical to that of the previously described embodiment. On the other hand, the lower discharge half has been modified in several respects. A first difference is the absence of a separate discharge head, providing a vacuum intake opening and cleaning fluid spray nozzle, attached to the bottom end of the unit. Instead, a vacuum head 6' having an intake opening 7' is formed as an extension of the return conduit 24 that is a unitarily molded portion of the lower half 3'. Additionally, the deflection conduit 26 is replaced by a schematically depicted vacuum valve 36 that precludes flow therethrough from the passage 24' into the receptacle portion 12', except when exposed to the action of the vacuum blower 8, thereby eliminating the possibility of cleaning fluid from the receptacle 12' from flowing out via the conduits 24', 26' and the opening 7' of the vacuum head 6'. Suitable normally closed vacuum valves known to the art will operate to open and permit fluid to flow through the conduit 24' into the receptacle 12 in response to a vacuum created in the plenum chamber 10.

Another modification incorporated into the embodiment of FIGS. 4 and 5 is that, instead of the filter 30 being carried by the end of a separate tube leading to the pump 22, in this embodiment, a filter 30' is attached over an inlet opening leading into an intake chamber 28a of a conduit 28', leading to the pump 22. The chamber 28a and conduit 28' like the conduit 31 of the first embodiment, are built into the wall of lower half 3', such as by being molded parts thereof. On the other hand, while the conduit from the pump 31' continues to be built into the wall of discharge half 3', it no longer extends all the way down into the vacuum head, but, instead, communicates with a separate spray nozzle 14' that projects from half 3' at a point above the vacuum head 6'. Spray nozzle 14' may be detachably connected to the outlet end of conduit 31' or may be built in to the exterior side of the associated wall of the half 3', such as by being molded thereto.

As can be appreciated, the embodiment of FIGS. 4 and 5 can be made more compactly and less costly than that of FIGS. 1–3 since fewer parts and fewer assembly steps will be involved. In fact, by building all of the various conduits into the wall of the lower discharge head half of the cleaner unit and eliminating the need for a distinct vacuum head arrangement, for the first time it becomes possible, with further modifications, to achieve a hand-held self-contained recycling extraction cleaner as will now be described with reference to the embodiment of FIGS. 6–7.

Again, in connection with this third embodiment, all elements which are the same as elements found in the first embodiment are designated by the same reference numeral, while corresponding but modified components are distinguished by a prime designation (in this instance, a double prime).

Figure 6:
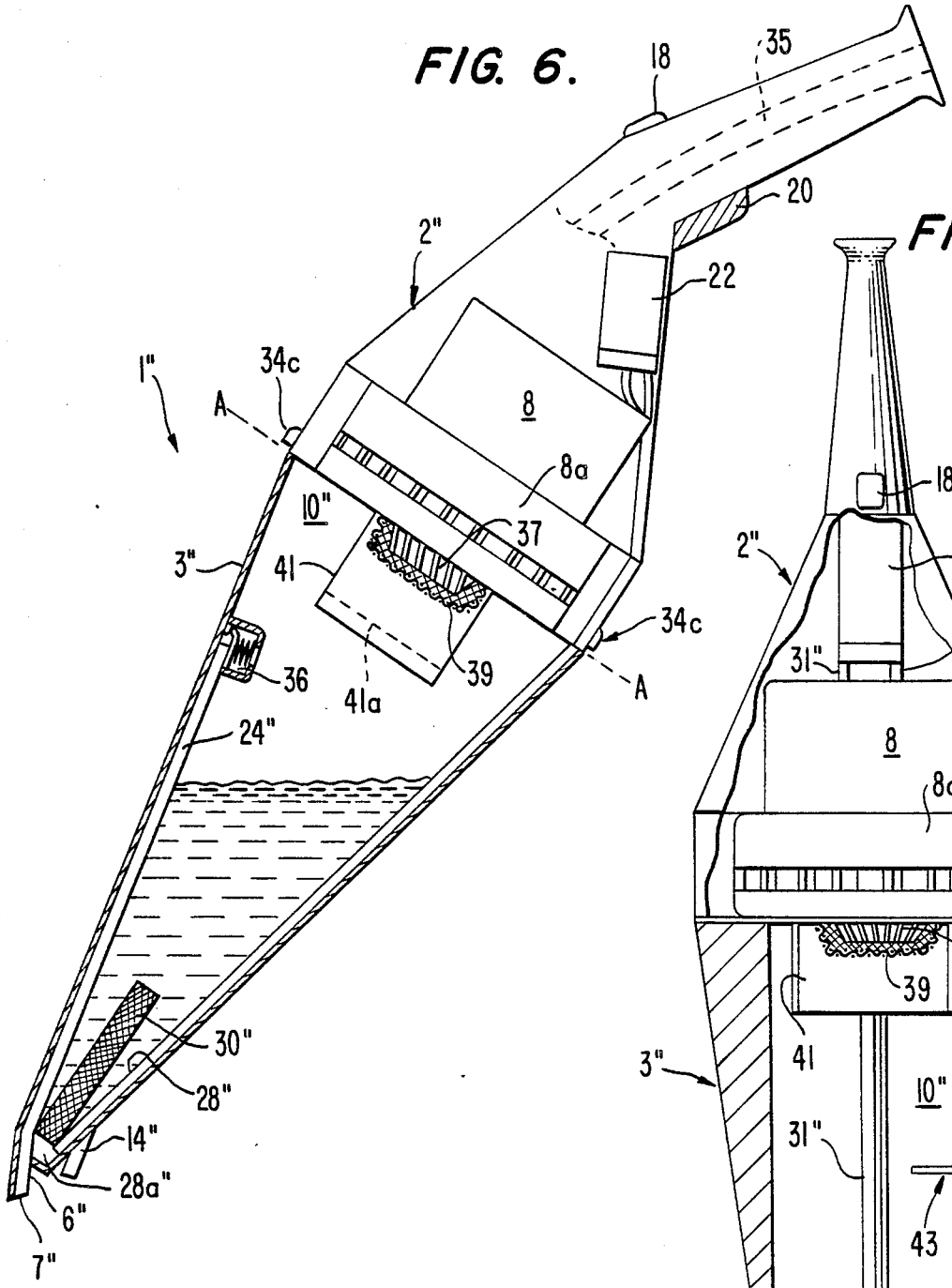
FIG. 6 is a side cross sectional view of a hand held embodiment in accordance with the present invention, FIG. 6*a* being an enlarged view taken along line X—X thereof.
Figure 7:
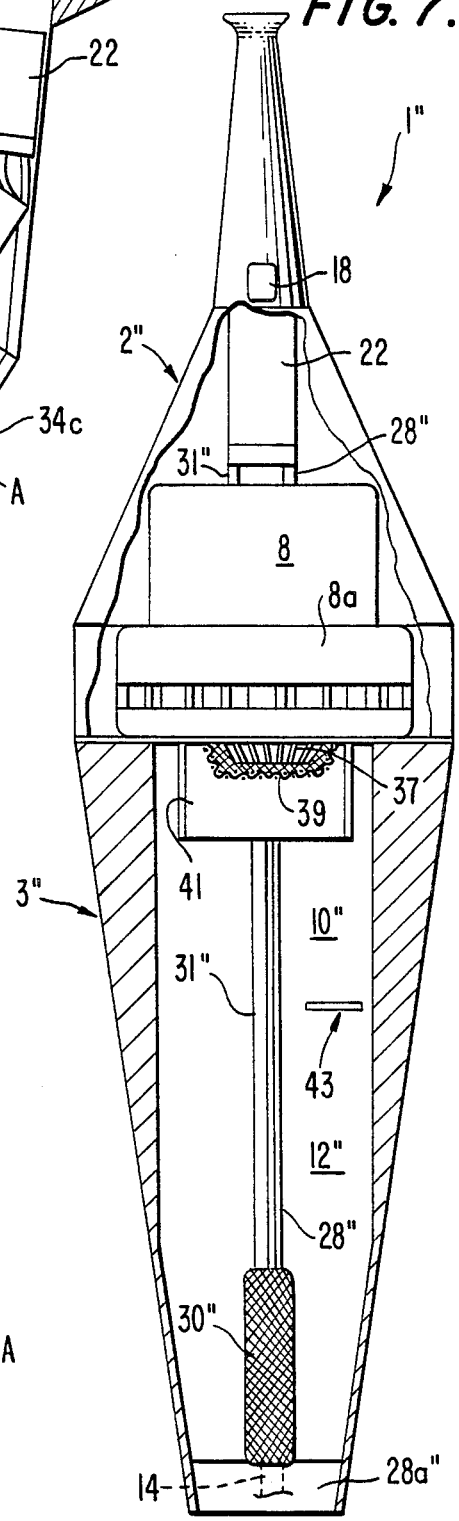
FIG. 7 is a partial sectional view of the embodiment shown in FIG. 6.

As with the embodiment of FIGS. 4 and 5, the vacuum intake head 6'' of the hand held version of FIG. 6 is formed as an extension of a built-in return conduit 24'' which extends to a vacuum responsive valve 36. Similarly, cleaning solution filter 30'' is mounted at the intake opening to an intake chamber 28a'' that communicates with a built-in conduit 28'' leading to the pump 22, and the spray nozzle 14'' is an externally projecting extension of a built-in delivery conduit 31''.

However, unlike the preceding embodiments, all of the electrical components, including the pump 22 are located in the handle half 2''. Accordingly, the conduits 28'' and 31'' to and from the pump 22, also have portions built into the wall of the handle half 2''.

Figure 6A:
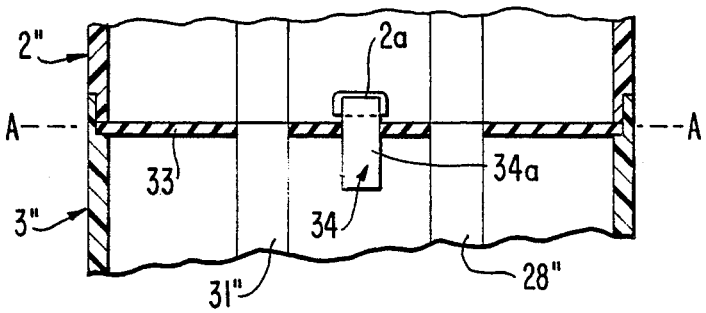

In order to insure proper alignment of the two halves and a leakproof junction therebetween, an arrangement as shown in FIG. 6a may be provided. In particular, the two halves 2'', 3'' are provided with stepped mating surfaces. For example, as shown, upper half 2'', is steppe d so that an exterior, circumferential recess groove is provided, while lower half 3'' is stepped in a reverse manner so that the circumferential recess groove is formed internally. Moreover, the height of the interior recess groove should be greater than the height of the exterior recess groove by an amount corresponding to an extent that will result in a circumferentially extending interior clearance space being created within which a gasket seal 33 will be firmly gripped when the two halves are fully pushed together.

In order to hold the two halves together in a manner compressing the gasket seal 33, a pair of latch members 34 are provided on, for example, the lower half 3'' which will automatically latch into corresponding openings 2a of the upper half 2''. For this purpose, the latch members 34 have a band-spring-like longitudinal extending body 34a to which a cam portion 34c radially outwardly projects. Thus, to separate the halves, the cam projections 34c need only be pressed inwardly until they disengage from the apertures 2a, whereupon the expansion force of the gasket seal 33 will produce a separation of the two halves to an extent preventing cam portions 34c from reengaging within the apertures 2a.

On the other hand, for resecuring the halves together, the tongue and groove surfaces of the two halves need only be recoupled together, the rounded upper surface of cam projection 34c and the flexibility of spring portion 34a enabling the latch members 34 to deflect to a non-interfering position. Thereafter, the two halves need only be pressed firmly together to an extent sufficient to slightly compress gasket seal 33, whereupon the cam portion 34c will be brought into alignment with the aperture 2a and the return force of the spring portion 34a will cause the cam portion 34c to move outwardly into the aperture 2a, relocking the halves together with a leak proof juncture formed between the halves. Such a form of junction and built in conduits eliminates the problem of dangling hoses or hose connections which must be plugged and unplugged for separation of the two halves 2'', 3''. Of course, it should be recognized that this form of juncture between the halves of the unit can be applied to either of the precedingly described embodiments, as well.

Inasmuch as the pump and vacuum motor are enclosed within a smaller handle half 2'', depending on the size of the motors and the heat produced thereby, it may be necessary to provide venting for the interior thereof. One such means is illustrated in FIG. 6, wherein a vent passage 35 is shown (in broken lines) extending through the handle 4''. How ever, any convenient venting arrangement may be utilized as well.

Furthermore, in view of the extreme compactness of the hand held version, and the likelihood that it will be placed in a horizontal orientation while containing cleaning fluid, for example, for cleaning upholstered furniture backs or simply being temporarily stored on a counter or other horizontal surface, several other features have been incorporated into this embodiment.

Firstly, the vacuum blower 8a of the vacuum motor 8 is provided with a centrifugal separator 37 that has a spirally grooved outer surface and which projects into the plenum 10'' of the discharge head half 3'' of unit 1''. Centrifugal separator 37 rotates with the vacuum blower and acts to separate any fluid that might be entrained within air being drawn in by the vacuum blower of the vacuum motor 8. To further minimize the likelihood of cleaning fluid becoming splashed up into the vacuum blower 8a, a separator guard 39, in the form of a splatter screen, may be placed over the centrifugal separator 37.

In order to further insure against cleaning fluid becoming spilled through the vacuum blower 8a when the unit 1'' is placed in a horizontal orientation, a separator spill guard 41 may be provided in addition to and/or instead of the separator guard screen 39. In a first form of such a spill prevention arrangement, the spill guard 41 is in the form of a simple cylindrical tube that coacts with the volumetric configuration of discharge head half 3'' and a visible fill level indicator 43 (FIG. 7) to prevent cleaning solution contained in the receptacle portion 12'' (below level indicator 43) from spilling into the vacuum motor intake if the unit is placed in a horizontal or handle-down vertical orientation.

In particular, the fill level indicator 43 may be in the form of a line or ridge on an interior wall of discharge head half 3'' that is visible from the exterior by either the entirety of half 3'' being made of transparent plastic material or by at least the wall portion upon which it is located and/or a corresponding portion of an opposite wall face being made transparent. Of course, any other known type of fill indicator can be utilized, such as a level indicator tube or electrical or mechanical fill level indicator.

Inasmuch as filling of the receptacle portion 12'' to the fill level indicator 43 will result in a predetermined quantity of cleaning liquid being situated therein, the diameter and height of the tube forming spill guard 41 can then be set so that, when the unit 1'', as a whole, is placed on its side or in a handle-down vertical position, the volume available below the open end of the tube forming spill guard 41 will be sufficiently large to contain the predetermined quantity of cleaning fluid plus, possibly, an additional amount capable of compensating for overfilling by the user or splashing of the cleaning liquid. Furthermore, the effectiveness of this feature is aided by providing a sloping surface along which the cleaning fluid will flow radially away from the spill guard 41 as the unit 1' is rotated clockwise from the orientation shown in FIG. 6, and by increasing the diameter of the discharge head half 3'' so as to produce a larger volume portion in the vicinity of the spill guard 41 than in receptacle portion 12'' below fill line 43, thereby enabling the height of the spill guard 41 to be kept to a minimum.

As an alternative spill prevention arrangement, it is also possible to incorporate a vacuum responsive valve **41*a* (represented schematically in FIG. 6 by broken lines) over the end of the spill guard 41. Such a vacuum responsive valve 41*a* would close the free end of spill guard 41 when the vacuum blower is off, but will open same under action of the vacuum created by the blower during operation. With such an arrangement, it may be possible to dispense with the separator guard 39 and centrifugal separator 37 because it would be unlikely that any significant quantities of cleaning liquid would pass through the vacuum responsive valve. On the other hand, any small quantities of liquid that might be drawn into the blower 8*a* would be atomized thereby and harmlessly dispensed, by the centrifugal force produced by the rotation thereof, outwardly through vents disposed circumferentially thereabout in a manner illustrated in FIGS. 1–4 at the widest portion of the unit. Still further, as an added precaution, the blower 8*a*** is sealed-off from the motor and pump.

Lastly, it is noted that while a separate vacuum motor and pump on-off switch 18, 20, has been shown in all embodiments, (in which case it may be desirable to provide a switch in the pump operation circuit precluding its operation unless the vacuum motor is on), it is also possible to utilize a single switch that operates both motors to have both the pump and blower driven by a single motor. Furthermore, no electrical cord is shown since it is contemplated that the hand-held version will be powered by a rechargeable battery pack as is conventional for portable, hand-held tools.

Industrial Applicability

By providing a cleaning apparatus that is relatively small, lightweight, easily affordable, and versatile, and is not limited in its cleaning capacity to the surface area that can be cleaned with a single application of a quantity of cleaning fluid that is carriable thereby, the present invention enables such an apparatus to be produced in not only floor models, but hand held models, as well. Furthermore, the constructions in accordance with the present invention make the units produced in accordance therewith, simple and easy to use by unskilled cleaning help and the average consumer.

By virtue of the above described features which enable the apparatus to be placed in various orientations, while loaded with cleaning solution, without damaging the apparatus or producing spillage, the apparatus of the present invention not only avoids related problems that could result from inadvertence or carelessness, but creates a "common element" type cleaning apparatus that is not restricted to cleaning of horizontal floor-type surfaces.

Use of the apparatus merely involves placing the vacuum head 6 in proximity to the surface area to be cleaned and actuating the pump 20 so as to spray cleaning fluid onto the surface by the spray nozzle 14. By moving the vacuum head 6 across the surface, the applied cleaning solution is agitated and then is withdrawn, along with any entrained solid material, upwardly through the opening 7 of the vacuum head into the receptacle portion 12. The extracted fluid can be re-applied after filtering by the filter 30. After several uses of the cleaning fluid, the dirty fluid, including any removed solid material, can easily be disposed of after separating of the discharge head half 3 from the handle half 2. This manner of operation is identical for all of the disclosed embodiments.

While several embodiments have been disclosed and described herein, those of ordinary skill in the art will appreciate the present invention is susceptible to numerous changes and modifications without departing from the spirit of the present invention. Accordingly, it is not intended that the present invention be limited to the embodiments disclosed herein, but rather is intended to encompass all forms within the scope of the appended claims.

We claim:

1. A compact, self-contained extraction cleaner for applying cleaning fluid to any surface of variable orientation to be cleaned and for picking up fluid and other material from said surface by a vacuum action comprising a body member having a handle section and a discharge head section removably connected at a first end to said handle section, said discharge head section having a closed second end opposite to said first end and being formed to provide a single chamber open only at said first end, said single chamber including a fluid receiving portion at the closed, second end and a plenum portion at the first end, said single chamber being opened for the receipt of cleaning fluid through said open first end of said discharge head section by the removal of said discharge head section from said handle section, a fluid delivery pump means mounted within said body member, first fluid conduit means mounted within said body member and extending between said fluid receiving portion and said fluid delivery pump means, a vacuum intake means formed adjacent to the second end of said discharge head section, vacuum conduit means connecting said vacuum intake means to said plenum portion, nozzle means mounted at said second end of said discharge head section and spaced relative to said vacuum intake means, said nozzle means being operative to apply cleaning fluid to said surface to be cleaned when said nozzle means is directed toward said variably oriented surface, second fluid conduit means mounted on said body member and extending between said nozzle means and said fluid delivery pump means, said fluid delivery pump means operating to draw cleaning fluid from said fluid receiving portion through said first fluid conduit means and to deliver cleaning fluid under pressure through said second fluid conduit means to said nozzle means, the handle section of said body member containing liquid affected electrical components including a vacuum motor and a vacuum blower means driven by said vacuum motor and having an intake side positioned to permit said vacuum blower means to create a vacuum in said plenum section when said handle section and discharge head section are connected together, and a centrifugal separator means mounted to be driven by said vacuum motor, said centrifugal separator means being mounted at a first end of said handle section and operating to extract fluid from the air reaching said vacuum blower means and vacuum motor when said discharge head section is connected to said handle section, said handle section including an elongated handle extending from a second end of said handle section opposite said first end thereof.

2. An extraction cleaner according to claim 1, wherein said fluid delivery pump means is located in said handle section, said first fluid conduit means including a first segment mounted in said discharge head section and a separate second segment mounted in said handle section and extending to said fluid delivery pump means and said second fluid conduit means including a third segment mounted on said discharge head section and extending to said nozzle means and a separate fourth segment mounted on said handle section and extending to said fluid delivery pump means, said first and second segments and said third and fourth segments respectively being positioned to mate when said discharge head section is connected to said handle section.

3. An extraction cleaner according to claim 1 wherein said fluid delivery pump means is mounted in said body member in spaced relation to said fluid receiving portion and filter means is mounted in said fluid receiving portion to filter cleaning fluid passing from said filter receiving portion to said first fluid conduit means, said first and second fluid conduit means being integrally formed in said body member.

4. A compact, self contained recycling extraction cleaner of a size and weight for enabling the cleaner to be held, without external support, in one hand of a user and variably operative in a range of operating modes from a horizontally oriented mode to a handle-down vertically oriented mode for applying fluid to a surface to be cleaned and for picking up fluid and other material from said surface by vacuum action, comprising:

a two piece body member formed by separate handle section and a discharge head section removably connectable at a first end to said handle section, a fluid delivery pump means and a vacuum generating means mounted within said handle section, said discharge head section having a closed second end opposite to said first end and having walls formed to provide a single chamber open only at said first end, said single chamber including a fluid receiving portion at the closed second end and a plenum portion at the first end, said single chamber being opened for the receipt of cleaning fluid through said open first end of said discharge head section by the removal of said discharge head section from said handle section, first fluid conduit means mounted on said body member and extending between said fluid receiving portion and said fluid delivery pump means, nozzle means mounted at said second end of said discharge head section, second fluid conduit means mounted on said body member and extending between said nozzle means and said fluid delivery pump means, said first conduit means including a first segment mounted on said discharge head section and a separate second segment mounted on said handle section and extending to said fluid delivery pump means, and said second fluid conduit means including a third segment mounted on said discharge head section and extending to said nozzle means and a separate fourth segment mounted on said handle section and extending to said fluid delivery pump means, said first and second and third and fourth segments respectively being positioned to mate when said discharge head section is connected to said handle section and said fluid delivery pump means being operative when said discharge head section is connected to said handle section to draw cleaning fluid from said fluid receiving portion through said first fluid conduit means and to deliver cleaning fluid under pressure through said second fluid conduit means to said nozzle means which applies cleaning fluid to said surface to be cleaned, a vacuum intake head formed adjacent to the second end of said discharge head section in spaced relation to said nozzle means, and vacuum conduit means connecting said vacuum head to said plenum portion.

5. An extraction cleaner according to claim 4 wherein said first end of said discharge head section is matingly engageable with a second end of said handle section, said vacuum generating means being operable to create a vacuum in said plenum section when said handle section and discharge head section are connected together, said vacuum generating means including a vacuum motor and a vacuum blower means driven by said vacuum motor and having an intake side positioned to permit said vacuum blower means to create a vacuum in said plenum section.

6. An extraction cleaner according to claim 5 wherein said handle section includes a handle extending outwardly away from an end thereof opposite to said second end, said handle section including means for protecting said vacuum motor from cleaning fluid from said fluid receiving portion when said extraction cleaner is operated in horizontally and handle-down vertically oriented modes, said protection means including a spill guard circumferentially surrounding the intake side of said vacuum blower means and extending outwardly from the second side of said handle section in spaced relation to the walls of said discharge head section when said discharge head section is connected to said handle section, a volumetric capacity being defined between the exterior surface of said spill guard and the walls of said discharge head section forming said plenum portion that is at least as great as the volumetric capacity of the fluid receiving portion.

7. The extraction cleaner according to claim 6 wherein the cross-sectional area of said discharge head section is greater at said first end than at said second end.

8. An extraction cleaner according to claim 7 wherein said first and second fluid conduit means are integrally formed on said discharge head and handle sections.

9. An extraction cleaner according to claim 8 wherein said vacuum conduit means comprises an intake conduit extending from said vacuum intake head to said plenum portion and a deflection conduit means at an outlet end of said intake conduit that is constructed to deflect fluid emerging from the outlet end of the intake conduit into the fluid receiving section, and a vacuum responsive valve means mounted in said intake conduit adjacent to said deflection conduit means, said vacuum responsive valve means being operative to normally close said intake conduit to prevent spillage of cleaning fluid contained in said fluid receiving portion through said vacuum conduit means, said vacuum responsive valve means opening when exposed to a vacuum in said plenum portion.

10. An extraction cleaner according to claim 9, wherein said discharge head section is provided with at least one internal sloping wall surface that is constructed and arranged for producing a flow of cleaning liquid radially away from the spill guard as the cleaner is rotated from the handle down vertically oriented to the horizontally oriented operating mode.

11. An extraction cleaner according to claim 6 wherein a centrifugal separator means is mounted to be driven by said vacuum motor to extract fluid from the air passing to the intake side of said vacuum blower means.

12. An extraction cleaner according to claim 11 wherein filter means is mounted in said fluid receiving portion to filter cleaning fluid passing from said fluid receiving portion into said first fluid conduit means.

* * * * *